US006945629B2

(12) United States Patent
Yamaguchi et al.

(10) Patent No.: US 6,945,629 B2
(45) Date of Patent: Sep. 20, 2005

(54) SUBSTRATE FOR INK JET HEAD, INK JET HEAD, AND INK JET RECORDING APPARATUS HAVING INK JET HEAD

(75) Inventors: Takaaki Yamaguchi, Kanagawa (JP); Yoshiyuki Imanaka, Kanagawa (JP); Takuya Hatsui, Kanagawa (JP); Muga Mochizuki, Kanagawa (JP); Souta Takeuchi, Kanagawa (JP); Kousuke Kubo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 131 days.

(21) Appl. No.: 10/620,556

(22) Filed: Jul. 17, 2003

(65) Prior Publication Data

US 2004/0017437 A1 Jan. 29, 2004

(30) Foreign Application Priority Data

Jul. 19, 2002 (JP) ..... 2002-211607

(51) Int. Cl.[7] ..... B41J 2/14; B41J 2/16

(52) U.S. Cl. ..... 347/48

(58) Field of Search ..... 347/48, 47, 20, 347/14, 10, 9, 5, 57, 54, 61, 62, 64, 65, 17

(56) References Cited

U.S. PATENT DOCUMENTS

| | | | | |
|---|---|---|---|---|
| 5,896,147 | A | 4/1999 | Mori et al. | |
| 5,943,070 | A | 8/1999 | Kamiyama et al. | |
| 6,243,111 | B1 | 6/2001 | Imanaka et al. | |
| 6,257,695 | B1 | 7/2001 | Kamiyama et al. | |
| 6,357,862 | B1 | 3/2002 | Ozaki et al. | |
| 6,688,729 | B1 * | 2/2004 | Imanaka et al. | 347/48 |
| 2002/0191052 | A1 | 12/2002 | Hirayama et al. | |

* cited by examiner

*Primary Examiner*—Raquel Yvette Gordon
(74) *Attorney, Agent, or Firm*—Fitzpatrick, Cella, Harper & Scinto

(57) ABSTRACT

In a substrate for an ink jet head used for an ink jet head recording apparatus, electrostatic breakdown of a diode sensor functional as a substrate temperature sensing element is prevented. A protective element is electrically connected between a diode sensor and an input/output pad for the diode sensor.

7 Claims, 4 Drawing Sheets

SUBSTRATE FOR INK JET HEAD, INK JET HEAD, AND INK JET RECORDING APPARATUS HAVING INK JET HEAD

BACKGROUND OF THE INVENTION

1. Field of the Invention

The present invention relates to a substrate for an ink jet head having a protective element for electrically protecting internal elements. The substrate is used for an ink jet head operable to record by discharging ink droplets from discharge ports. The invention is further directed to an ink jet head having such a substrate for the ink jet head and an ink jet head recording apparatus having such an ink jet head.

2. Related Background Art

Conventionally, an ink jet recording method of recording on a recording medium (papers in most cases) via discharge and flow of ink droplets from discharge ports is known. This ink jet recording method, which is a non-impact type recording method, has recently been popularized rapidly because it has relatively low noise generation, is capable of recording directly on a paper, and also is capable of easily recording color images by using multi-colors of ink. Among a variety of recording methods, particularly known is that of forming ink bubbles by applying thermal energy to ink responsive to recording signals and then, with an action force generated thereupon, discharging and flowing the ink from discharge ports. This method has an advantage in that an ink jet head with high density multi-nozzles capable of providing high-resolution high-speed recording may be easily realized and obtained.

An ink jet head used for this recording method is, in most cases, provided with a number of discharge ports for discharging ink, liquid channels each of which is provided for the discharge port and is in communication therewith, and a common liquid chamber for stably supplying ink into each liquid channel. This ink jet head utilizes thermal energy generated when a heater is energized through a driver, and thereby discharges ink delivered from the liquid channels from the discharge ports for a recording operation.

Such an ink jet head is so constituted, for example, that a substrate for an ink jet head is joined to a top plate on which is formed liquid channels, a liquid chamber, discharge ports, and the like. The substrate for an ink jet head comprises heaters (heating elements) for generating thermal energy to discharge ink, drivers for driving these heaters, a logic circuit for controlling the drivers, a substrate temperature sensing element for sensing substrate temperatures, a pad unit for electrically connecting the ink jet head and an ink jet recording apparatus with each other, and the like. The heaters are formed at positions corresponding to respective discharge ports and so arranged that the number of heaters may be compatible with that of the discharge ports. Therefore, the drivers are formed compatibly with the number of discharge ports. Such a substrate for an ink jet head is monolithically fabricated of a silicon semiconductor substrate according to semiconductor device manufacturing techniques. Particularly in the substrate for an ink jet head, since discharge properties of ink droplets discharged from the discharge ports in the ink jet head and substrate temperatures are closely related to each other, sensing of substrate temperatures is given a relative importance.

As the substrate temperature sensing element provided on the substrate for an ink jet head, a diode sensor is used, which may be formed on a silicon substrate by semiconductor manufacturing techniques and may provide accurate temperature measurement. By using the diode sensor, temperatures of the substrate for an ink jet head during operations or the like of the ink jet recording apparatus are sensed in accordance with temperature properties of forward voltage in a semiconductor diode.

As described above, on the substrate for an ink jet head, driver circuits, logic circuits, and the like are integrated, and the ink jet head embedded therein with such a substrate for an ink jet head is expected to be exchanged by users, so that it is so designed as to be touchable by users when exchanged. Therefore, when electrostatic discharge is generated at the time users handle the ink jet head, there sometimes arises a problem such that an electric current caused by the static electricity is applied to the substrate for the ink jet head via the pad unit of the ink jet head or via wirings, and then components weak in resisting the static electricity are damaged, leading to element breakdown. Particularly, the substrate temperature sensing element such as the diode sensor for sensing substrate temperatures is susceptible due to its weakness in resistance to electrostatic breakdown.

Accordingly, it is desired to provide a substrate for an ink jet head which has improved electrostatic breakdown resistance, an ink jet head having such a substrate for an ink jet head, and an ink jet recording apparatus using such an ink jet head.

SUMMARY OF THE INVENTION

To address the foregoing objects, according to the present invention, a substrate temperature sensing element provided on a substrate for an ink jet head is electrically connected to a protective element, thereby improving resistance against electrostatic breakdown.

More specifically, the substrate for an ink jet head in the present invention has a plurality of heaters for discharging ink, a drive circuit for driving the plurality of heaters, and a substrate temperature sensing element for sensing substrate temperatures, all of which are formed on the same substrate. The substrate is characterized in that a protective element is provided between the substrate temperature sensing element and a connection pad which is electrically connected with the substrate temperature sensing element and which establishes electrical connection with external components.

An ink jet head in the present invention is characterized by comprising the substrate for the ink jet head described above and a member for forming a liquid channel jointed to the substrate for the ink jet head and associated with the heater and also for forming an ink discharge port which belongs to one end of the liquid channel.

An ink jet recording apparatus in the present invention is characterized by comprising the ink jet head according to the present invention and means for applying signals to the connection pad to acquire information about head temperature by supplying the signals to the connection pad.

DESCRIPTION OF THE PREFERRED EMBODIMENTS

In the following, a preferred embodiment of the present invention will be described with reference to drawings.

Note here that the term "on a substrate" described herein refers to not only an upper part of an element base, but also a surface thereof and an inner side thereof in the vicinity of the surface. Furthermore, the term "built-in" in the present invention does not indicate to simply arrange each of separate elements on the base but does indicate to form and fabricate each element integrally on the element base through a fabricating process for semiconductor circuits.

Figure 1:
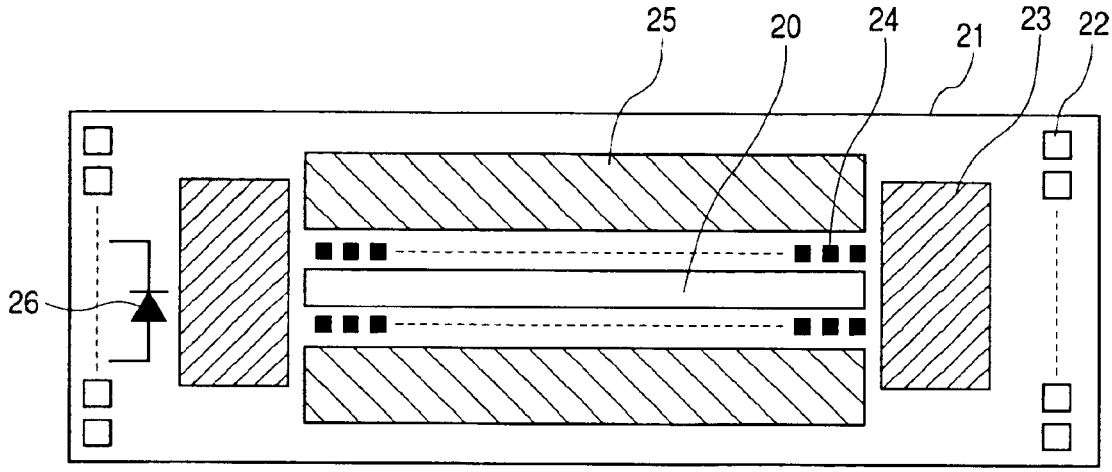
FIG. 1 is a plan view showing a configuration of a substrate for an ink jet head according to one embodiment of the present invention.

FIG. 1 is a plan view showing a substrate for an ink jet head according to one embodiment of the present invention.

This substrate for an ink jet head (element substrate) 21, which is formed on (built-in) a silicon semiconductor substrate using semiconductor device manufacturing techniques, has a substantially rectangular shape and includes a through hole functional as an ink supply port 20 extending in a longitudinal direction, which is formed in the center of the substrate 21 in the drawing. Along two sides of the ink supply port 20, a plurality of heaters 24 is arranged. Each of the heaters 24 heats a liquid (ink) supplied from a rear side of the drawing sheet of the substrate for an ink jet head 21 via the ink supply port 20 to form bubbles and discharges ink droplets from discharge ports (not shown in FIG. 1) arranged facing the heaters 24 (recording elements). On an opposite side of the ink supply port 20 across the heaters 24, a driver unit 25 is provided. The driver unit 25 includes drivers and others for driving each heater 24. Each of the drivers is typically provided for the respective heaters 24 and is composed of transistors for switches and others. Furthermore, the substrate for an ink jet head 21 has a logic circuit unit 23 and a pad unit for supplying power source and signals to this substrate for an ink jet head from a main body of a recording apparatus. The pad unit includes a plurality of pads 22 for routing wirings to the outside of the substrate by using electrical connection means such as wire bonding to electrically connect the ink jet head with the ink jet head recording apparatus. The logic circuit unit 23 includes logic circuits for controlling, when signals are given by the main body of the recording apparatus via the pads 22, ON/OFF of each transistor in the driver unit 25 responsive to the signals. Moreover, the substrate for an ink jet head 21 has a temperature sensor 26 composed of a diode sensor to monitor substrate temperatures reflecting head temperatures from the apparatus main body side. The apparatus main body supplies signals to the temperature sensor and receives signals reflecting temperatures outputted from the temperature sensor.

The ink jet head having such a substrate for an ink jet head 21 is controlled when the logic circuits in the logic circuit unit 23 perform ON/OFF operations of transistors, i.e., drivers in the driver unit 25 upon receipt of signals inputted to the substrate for an ink jet head 21 via the pads 22. And when the heater 24 corresponding to the transistor being turned ON is energized, the heater 24 is warmed up, ink (liquid) on the heater 24 is heated to thereby rapidly generate ink bubbles, and consequently the ink is discharged from the discharge ports.

Next, the diode sensor in the substrate of an ink jet head according to the embodiment will be described.

Figure 2:
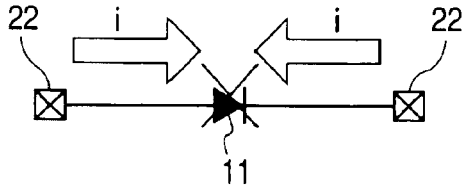
FIG. 2 is a diagram showing a circuit figure of a general diode sensor and a breakdown mode due to static discharge.

FIG. 2 is an equivalent circuit diagram showing the case where a typical diode sensor 11 is connected from an input/output pad. Conventionally, the diode sensor 11 for sensing a temperature has been used for extremely simple connection such that anode and cathode of the diode sensor 11 are respectively connected to a pair of input pads. In this case, when static discharge is applied to the ink jet head, a large current i due to this static discharge flows into the substrate for an ink jet head 21 from a contact portion of the ink jet head via the pads 22 of the substrate for an ink jet head 21. The large current i flowing into the substrate 21 is all applied to elements themselves of the diode sensor, occasionally resulting in breakdown of the elements.

Figure 3:
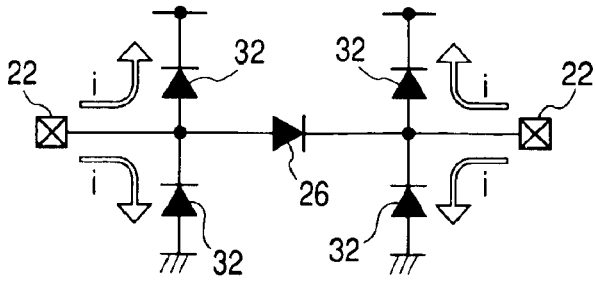
FIG. 3 is an equivalent circuit diagram showing a diode sensor in the substrate for an ink jet head according to one embodiment of the present invention.

The substrate for an ink jet head 21 of the present invention is provided with protective diodes 32 as a protective element on respective anode and cathode sides of the diode sensor 26 as shown in FIG. 3. The protective diodes 32 are disposed between the anode of the diode sensor 26 and a power source line, between the anode and a ground, between the cathode and the power source line, and between the cathode and the ground, respectively. In this case, the protective diodes are so arranged that the anodes of the protective diodes connected to the ground side may be connected to the ground, and the cathodes of the protective diodes connected to the power source line side may be connected to the power source line, on condition that the power source in the substrate for an ink jet head is a positive power source.

Such constitution allows electric charge flowing toward the diode sensor 26 due to static discharge to be positively dispersed and to escape to the outside. That is, the large current i of the static electricity flows into the ground and the power source line without being applied to the diode sensor 26. As a result, resistance against static electricity of this substrate temperature sensing element (diode sensor) is enhanced.

The substrate for an ink jet head 21 is provided with the logic circuit unit 23 as previously described, and it is preferable that the protective diode 32 used herein as a protective element has the same size as that connected to the logic circuits in the logic circuit unit 23. The logic circuit in the substrate for an ink jet head is generally a CMOS circuit which usually includes such a protective diode.

Figure 4:
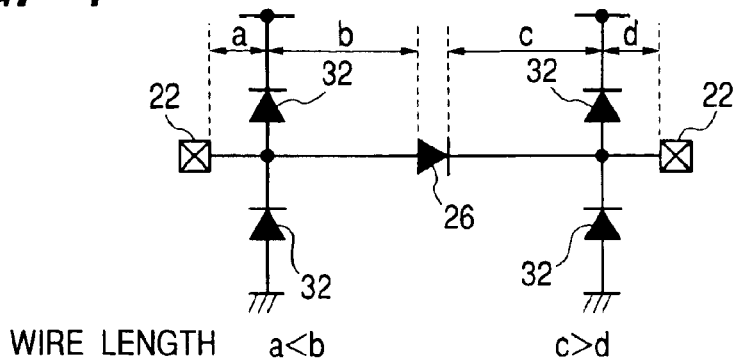
FIG. 4 is an equivalent circuit diagram showing another example of the diode sensor in the substrate for an ink jet head according to one embodiment of the present invention.

Furthermore, as shown in FIG. 4, the protective diode 32 is arranged in the vicinity of the input pad 22, which leads to an increase in resistance to static electricity. The location of the protective diode is desirably in the vicinity of the input pad 22, but it may be closer to the pad than an intermediate position of wiring between the input pad and the diode sensor, taking the alignment into account.

More specifically, in a state shown in FIG. 2, the diode sensor element breakdown occurs under static electricity applied voltage of 2 kV on a contact discharge condition (discharge resistor 330 Ω, discharge condenser 150 pF).

However, it does not occur by employing the configuration shown in FIG. 4 under the applied voltage lower than 4 kV.

Figure 5:
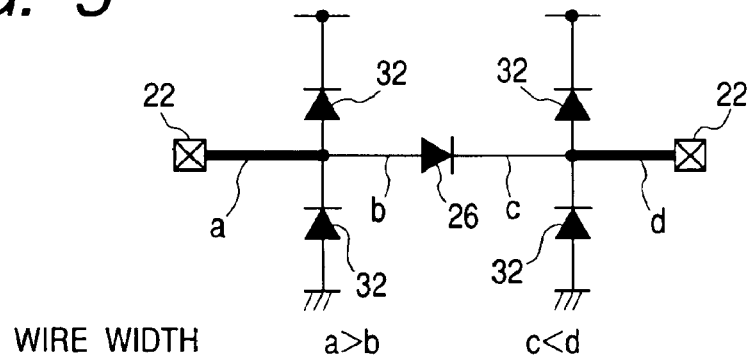
FIG. 5 is an equivalent circuit diagram showing still another example of the diode sensor in the substrate for an ink jet head according to one embodiment of the present invention.

However, even if the breakdown resistance of the diode sensor itself is enhanced by providing the protective element, wiring disconnection may occur between the input element and the protective element 32 due to the instantaneous large current i of the applied voltage if a wiring width up to the protection element (a, d portion in FIG. 5) is thin (or narrow). It is therefore conceivable that the diode sensor 26 resultantly goes into a disconnection state. Accordingly, it is preferable that the wiring between the input pad 22 and the protective element 32 is wide enough to resist the instantaneous current, and more desirably, that the wiring between the input pad 22 and the protective element 32 indicated by a is wider than that between the protective element 32 and the diode sensor 26 indicated by b, and the wiring between the input pad 22 and the protective element 32 indicated by d is wider than that between the protective element 32 and the diode sensor 26 indicated by c, as shown in FIG. 5.

The wiring width between the input pad 22 and the protective element 32 may be 8 mm or wider, more preferably, 10 mm or wider. This makes it possible to obtain a configuration resistant enough to the large current before its dispersion and escape to the power source. Such a configuration achieves further improvement of the breakdown resistance against static electricity.

Figure 6:
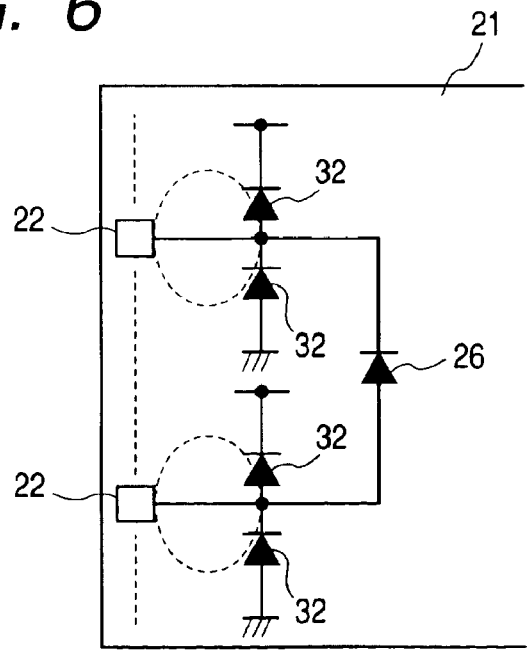
FIG. 6 is an equivalent circuit diagram showing still another example of the diode sensor in the substrate for an ink jet head according to one embodiment of the present invention.

The substrate for an ink jet head 21 is manufactured using semiconductor device manufacturing techniques as described above, and thus the logic circuit unit 23 and the driver unit 25 have substantially the same configuration as that of a semiconductor integrated circuit. Therefore, the substrate for an ink jet head 21 adopts a multi-layer wiring configuration. In the case where the wiring between the input pad 22 and the protective element 32 intersects with another wiring layer, a step is formed at the intersecting portion. If the large current i due to static discharge passes through such a step, wiring breaks may occur at the step in the wiring intersecting portion. Therefore, it is preferable that, as shown in FIG. 6, a wiring portion (indicated by a broken line in the drawing) between the pad 22 and the protective element 32 has no steps formed by intersecting wirings. This makes it possible to further enhance the breakdown resistance against static discharge.

Figure 7:
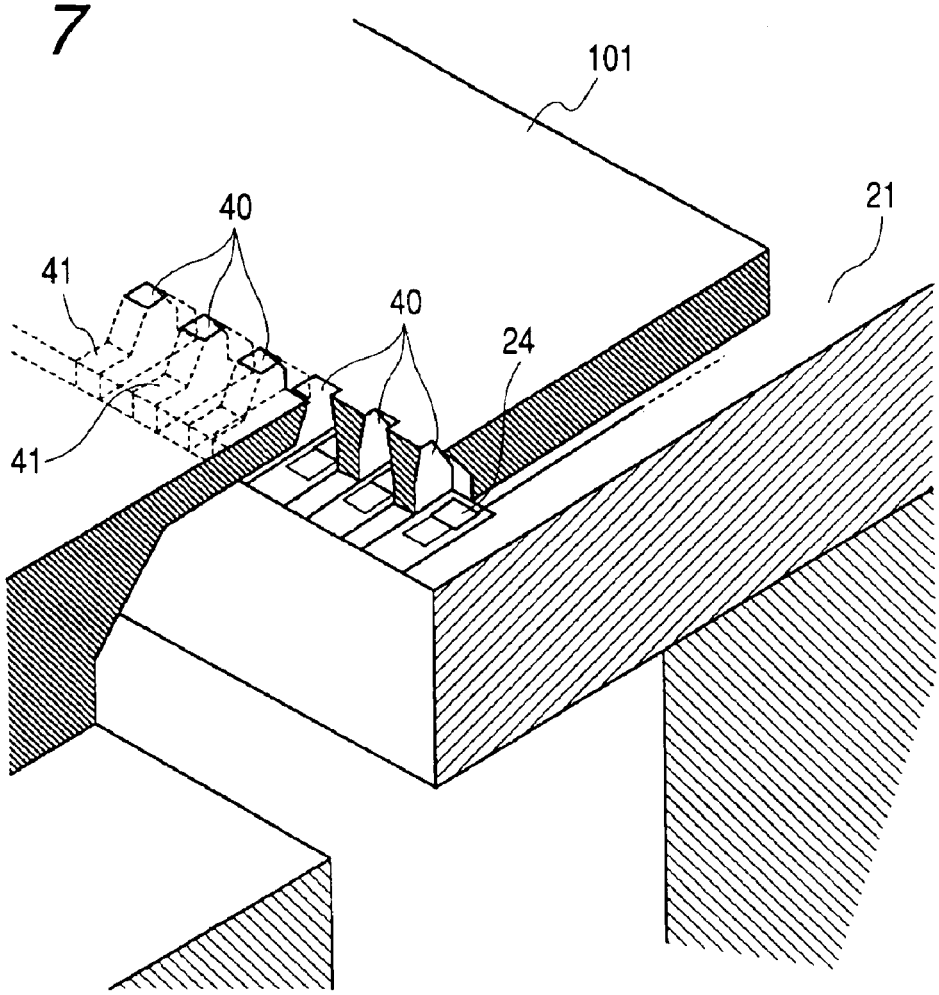
FIG. 7 is a diagram schematically showing a constitution of an ink jet head using the substrate for an ink jet head shown in FIG. 1.

Next, a schematic constitution of the ink jet head of the present invention using the substrate for an ink jet head 21 in the foregoing description will be described referring to FIG. 7. As described above, in this embodiment, the heaters 24 are arranged on two sides of the ink supply port 20. In FIG. 7, however, only the heaters 24 on one side of the ink supply port 20 and the corresponding discharge ports 40 are shown for simple description.

As is described above, on the substrate for an ink jet head 21, the plurality of heaters 24 are linearly arranged, which generates heat by receiving electric signals to discharge ink from the discharge ports 40 by bubbles formed by the heat. Channels 41 for supplying ink to the discharge ports 40 provided at positions facing respective heaters 24 are arranged corresponding to each of the discharge ports 40. These discharge ports 40 are formed on an orifice plate 101. By connecting the orifice plate 101 to the foregoing substrate for an ink jet head 21, a common liquid chamber is provided, which is in communication with the ink supply port 20 and supplies ink to each channel 41.

Figure 8:
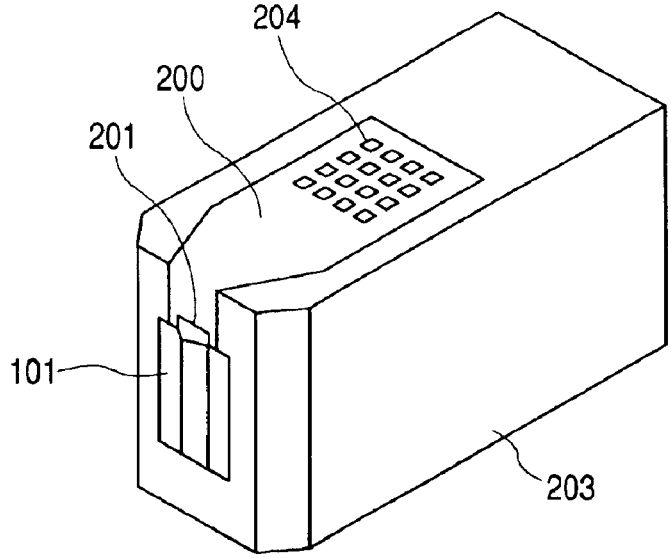
FIG. 8 is a diagram showing an external appearance of the ink jet head shown in FIG. 7.

FIG. 8 shows an external appearance of one example of the ink jet head. On a TAB tape 200, an electrical connection unit 201 with the substrate for an ink jet head 21 is provided, and on one end side of the TAB tape 200, a contact pad unit 204 used for connection with the recording apparatus is formed. The substrate for an ink jet head 21 of the present invention is disposed under the orifice plate 101. To the substrate for an ink jet head 21 on which the channels 41 are formed with a dry film or the like, an orifice plate 101 is attached, and thereafter it is joined to an ink tank 203 having the TAB tape 200 attached thereon, which is followed by bonding. Then, the electrical connection unit 201 in the TAB tape 200 is sealed by a sealing material to bring the ink jet head to completion.

This ink jet head is detachable and therefore may be touched with human hands. This means there is the possibility that static discharge may be applied from the contact pad unit 204. When the static electricity is applied to the contact pad unit, the applied static electricity is discharged as far as the substrate for an ink jet head 21 via the TAB tape 200.

Figure 9:
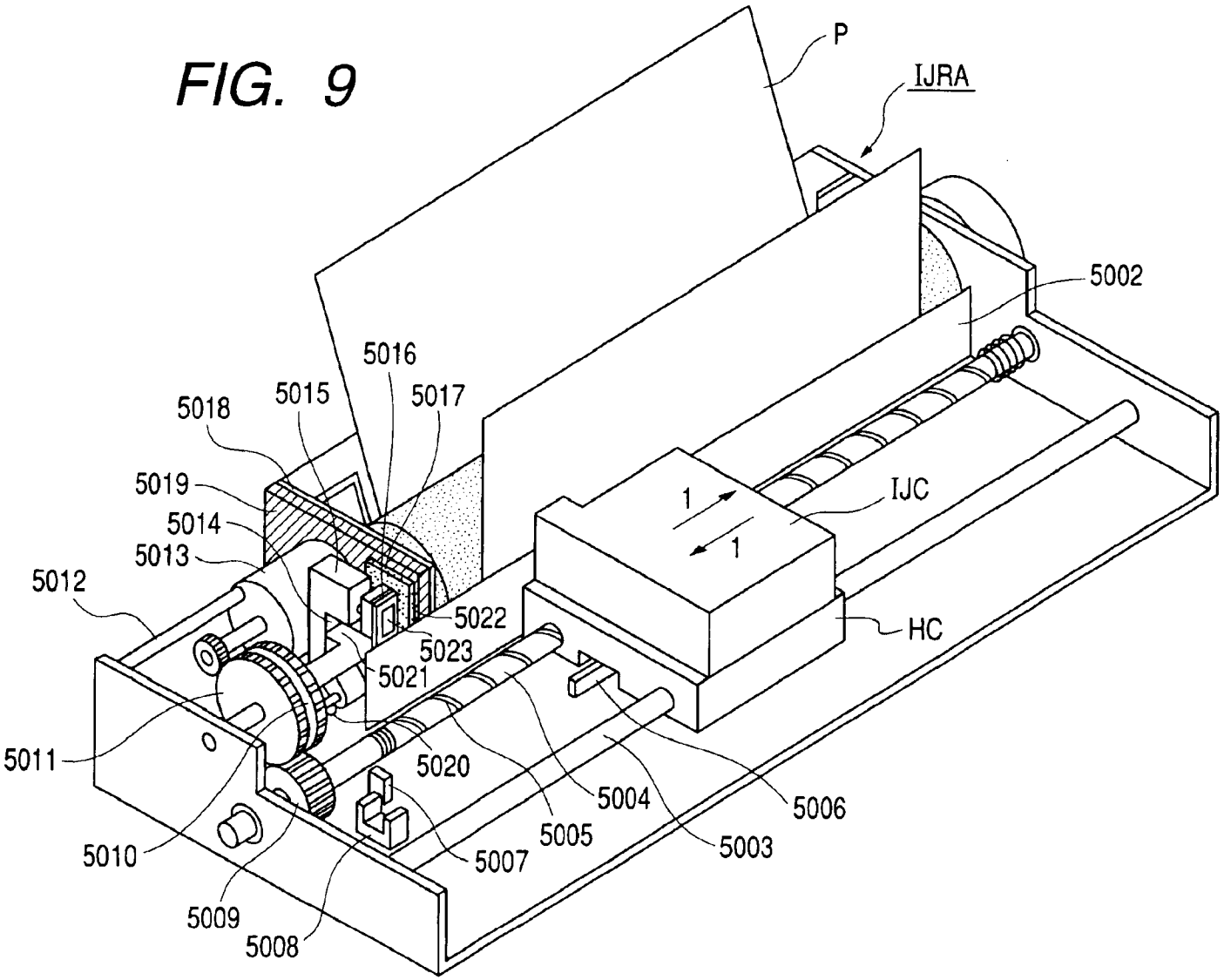
FIG. 9 is a perspective view showing an example of a constitution of an ink jet recording apparatus using the ink jet head shown in FIG. 7.

FIG. 9 shows an external appearance schematically showing an ink jet recording apparatus IJRA to which the ink jet head of the present invention is applied.

A carriage HC, which is engaged with a helical groove 5004 of a lead screw 5005 that is rotated interlockingly with forward reverse revolution of a drive motor 5013 via driving force transmission gears 5009, 5011, is removably mounted with the ink jet head, has a pin (not shown), and is reciprocated in directions of arrows a and b. A sheet press plate 5002 presses a print medium (in several, a paper) against a platen 5000 which is a print medium conveying means, over the entire range of movement of the carriage HC. A photocoupler 5007, 5008 is a home-position detector for performing switching of the direction of revolution of the driving motor 5013 by ascertaining the presence of a lever 5006 of the carriage HC within the above-described range. A member 5016 supports a cap member 5022 for capping a front surface of the ink jet head, and suction means 5015 sucks the inside of the capped portion in order to perform suction recovery of the ink jet head via an opening 5023 in the capped portion. Reference numeral 5017 denotes a cleaning blade, and reference numeral 5019 denotes a member which allows the movement of the cleaning blade in forward and reverse directions. Both the cleaning blade 5017 and the member 5019 are supported on a supporting plate 5018. It is to be understood here that the cleaning blade is not limited to the illustrated type, and well-known cleaning blades are definitely applicable to this embodiment. A lever 5021 initiates suction for suction recovery and is moved in accordance with the movement of a cam 5020 which is engaged with the carriage HC. A driving force from the driving motor is controlled for this movement via a known transmission mechanism, such as clutch switching or the like.

Each of these capping, cleaning and suction recovery means is configured so that desired processing can be performed at a corresponding position by the operation of the lead screw 5005 when the carriage HC reaches a region at the home position side and can be applied to this embodiment providing that a desired operation is performed at a well-known timing. Each constitution in the foregoing is an excellent invention in and of itself, as well as their combination, and is shown as preferable examples of the present invention.

This recording apparatus includes a signal supplying means for supplying driving signals to drive heat elements or other signals to the ink jet head (substrate for an ink jet head).

As described above, the present invention has an advantage that the resistance against electrostatic breakdown can be enhanced without increasing the substrate size by providing the protective elements to electrically connect the temperature sensing diode sensor and the input pad with each other.

What is claimed is:

1. A substrate for an ink jet head including a plurality of heaters for discharging ink, a driving circuit for driving the plurality of heaters, and a substrate temperature sensing element for sensing a substrate temperature, all of which are formed on the same substrate, wherein a protective element is provided between the substrate temperature sensing element and a connection pad electrically which is connected with the substrate temperature sensing element and which establishes electrical connection with an external component, and wherein a wiring width between the connection pad and the protective element is wider than that between the protective element and the substrate temperature sensing element.

2. A substrate for an ink-head including a plurality of heaters for discharging ink, a driving circuit for driving the plurality of heaters, and a substrate temperature sensing element for sensing a substrate temperature, all of which are formed on the same substrate, wherein a protective element is provided between the substrate temperature sensing element and a connection pad electrically which is connected with the substrate temperature sensing element and which establishes electrical connection with an external component, and wherein the protective element is provided for a logic circuit unit composing the driving circuit, and a size of the protective element connected to the substrate temperature sensing element is equal to that of the protective element connected to the logic circuit unit.

3. A substrate for an ink jet head including a plurality of heaters for discharging ink, a driving circuit for driving the plurality of heaters, and a substrate temperature sensing element for sensing a substrate temperature, all of which are formed on the same substrate, wherein a protective element is provided between the substrate temperature sensing element and a connection pad electrically which is connected with the substrate temperature sensing element and which establishes electrical connection with an external component, and wherein the substrate temperature sensing element includes a diode sensor.

4. The substrate for an ink jet head according to claim 3, wherein the protective elements are a protective diode, and is disposed between an anode of the diode sensor and a power source line, between the anode and a ground, between a cathode of the diode sensor and the power source line, and between the cathode and the ground, respectively.

5. An ink jet head attachable/detachable to an ink jet recording apparatus comprising:

a substrate for an ink jet head according to any one of claims 1, 2 and 3; and a member for forming a liquid channel jointed to the substrate for an ink jet head and associated with the heater and also forming a discharge port which belongs to one end of the liquid channel.

6. An ink jet recording apparatus comprising:

a head including a substrate for an ink jet head according to any one of claims 1, 2 and 3; and means for applying signals to the connection pad to acquire information about head temperature by supplying the signals to the connection pad.

7. The ink jet recording apparatus according to claim 6, further comprising:

a carriage operable to removably support the ink jet head and to make the ink jet head to scan a print medium.

* * * * *